US010689952B2

(12) United States Patent
Kuznetz et al.

(10) Patent No.: US 10,689,952 B2
(45) Date of Patent: Jun. 23, 2020

(54) SYSTEM AND METHOD REMOVAL OF CONTAMINANTS FROM DRILL CUTTINGS

(71) Applicant: M-I L.L.C., Houston, TX (US)

(72) Inventors: Michael Kuznetz, Houston, TX (US); Maneesh Goswami, Cypress, TX (US)

(73) Assignee: M-I L.L.C., Houston, TX (US)

( * ) Notice: Subject to any disclaimer, the term of this patent is extended or adjusted under 35 U.S.C. 154(b) by 675 days.

(21) Appl. No.: 14/956,873

(22) Filed: Dec. 2, 2015

(65) Prior Publication Data

US 2016/0160612 A1 Jun. 9, 2016

Related U.S. Application Data

(60) Provisional application No. 62/087,649, filed on Dec. 4, 2014, provisional application No. 62/089,485, filed on Dec. 9, 2014.

(51) Int. Cl.
*E21B 41/00* (2006.01)
*E21B 21/06* (2006.01)

(52) U.S. Cl.
CPC ..... *E21B 41/005* (2013.01); *E21B 21/066* (2013.01)

(58) Field of Classification Search
CPC ..... E21B 21/06; B08B 3/00
See application file for complete search history.

(56) References Cited

U.S. PATENT DOCUMENTS 3,455,606 A 7/1969 Fischer et al.
3,777,551 A * 12/1973 Weiss ..... E21B 21/08 73/54.28
4,845,981 A * 7/1989 Pearson ..... B01F 15/00207 73/152.31
6,176,323 B1 * 1/2001 Weirich ..... E21B 21/08 175/40
2004/0195152 A1 * 10/2004 Massetti ..... B01D 11/0219 209/11
2007/0056611 A1 * 3/2007 Martin ..... B03B 9/02 134/42
2012/0298559 A1 * 11/2012 Newman ..... C10G 1/04 208/298
2014/0166361 A1 * 6/2014 Jamison ..... E21B 21/065 175/24

FOREIGN PATENT DOCUMENTS

CN 1410655 A 4/2003
CN 1737335 A 2/2006
CN 102587914 A 7/2012
CN 103696771 A 4/2014

OTHER PUBLICATIONS

International Search Report and Written Opinion for the equivalent International patent application PCT/US2015/063714 dated Feb. 23, 2016.
International Preliminary Report on Patentability for the equivalent International patent application PCT/US2015/063714 dated Jun. 6, 2017.

* cited by examiner

*Primary Examiner* — William D Hutton, Jr.
*Assistant Examiner* — Avi T Skaist
(74) *Attorney, Agent, or Firm* — Jeffrey D. Frantz

(57) ABSTRACT

Embodiments disclosed herein relate to a method including passing liquid carbon dioxide over drill cuttings carrying contaminants to form a mixture comprising liquid carbon dioxide and a portion of the contaminants; measuring a property of the mixture; and terminating the passing liquid carbon dioxide over drill cuttings based on the measured property.

10 Claims, 13 Drawing Sheets

SYSTEM AND METHOD REMOVAL OF CONTAMINANTS FROM DRILL CUTTINGS

CROSS-REFERENCE TO RELATED APPLICATIONS

This application claims benefit of U.S. patent application Ser. No. 62/087,649, filed Dec. 4, 2014 and titled, "REMOVAL OF CONTAMINANTS FROM DRILL CUTTINGS," and of U.S. patent application Ser. No. 62/089,485, filed Dec. 9, 2014 and titled, "REMOVAL OF CONTAMINANTS FROM DRILL CUTTINGS," the entire disclosure of which is herein incorporated by reference.

BACKGROUND

In the drilling of wells, a drill bit is used to dig many thousands of feet into the earth's crust. Oil rigs typically employ a derrick that extends above the well drilling platform. The derrick supports joint after joint of drill pipe connected end to end during the drilling operation. As the drill bit is pushed further into the earth, additional pipe joints are added to the ever lengthening "string" or "drill string." Therefore, the drill string includes a plurality of joints of pipe. "Drilling mud" is pumped from the well drilling platform, through the drill string, and to a drill bit supported at the lower or distal end of the drill string. The drilling mud lubricates the drill bit and carries away well cuttings generated by the drill bit as the drill bit digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a vibratory separator or "shale shaker" is typically used to remove the drilling mud from the drill cuttings so that the drilling mud can be reused. The remaining drill cuttings, waste, and residual drilling mud are then transferred to a holding trough for disposal. In some situations, for example with specific types of drilling mud, the drilling mud may not be reused and should be disposed.

The non-recycled drilling mud is disposed of separate from the drill cuttings and other waste by transporting the drilling mud via a vessel to a disposal site. The disposal of the drill cuttings and drilling mud is a complex environmental problem. Drill cuttings contain not only the residual drilling mud product that would contaminate the surrounding environment, but can also contain oil and other waste that is hazardous to the environment, especially when drilling in a marine environment. Thus, after drill cuttings are processed through vibratory separators, the drill cuttings are further treated to remove residual hydrocarbons and contaminants from drill cuttings and drilling.

SUMMARY

In one aspect, embodiments disclosed herein relate to a method including passing liquid carbon dioxide over drill cuttings carrying contaminants to form a mixture comprising liquid carbon dioxide and a portion of the contaminants; measuring a property of the mixture; and terminating the passing liquid carbon dioxide over drill cuttings based on the measured property.

In another aspect, embodiments disclosed herein relate to a method disposing drill cuttings carrying a contaminant within an extraction vessel; contacting the drill cuttings with an expandable liquid solvent to form a mixture comprising the expandable liquid solvent and a portion of the contaminants; expanding the mixture to separate the expandable liquid solvent from the contaminants to recover an expanded solvent stream and a contaminant stream; measuring a property of the mixture or the contaminant stream; and terminating the contacting based on the measured property.

In another aspect, embodiments disclosed herein relate to a system having an extraction tank fluidly coupled to a contaminated drill cuttings source and an expandable liquid solvent source; a separation tank fluidly coupled to the extraction tank to receive a mixture comprising the expandable liquid solvent and contaminants and to separate the contaminants from the contaminated drill cuttings; a measurement device to measure a property of the mixture or the contaminants separated from the contaminated drill cuttings; and a system controller configured to cyclically (a) load the extraction tank with the contaminated drill cuttings, (b) contact the contaminated drill cuttings with the expandable liquid solvent; and (c) remove cleaned drill cuttings from the extraction tank. The system controller is further configured to terminate (b) based on the measured property.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1:
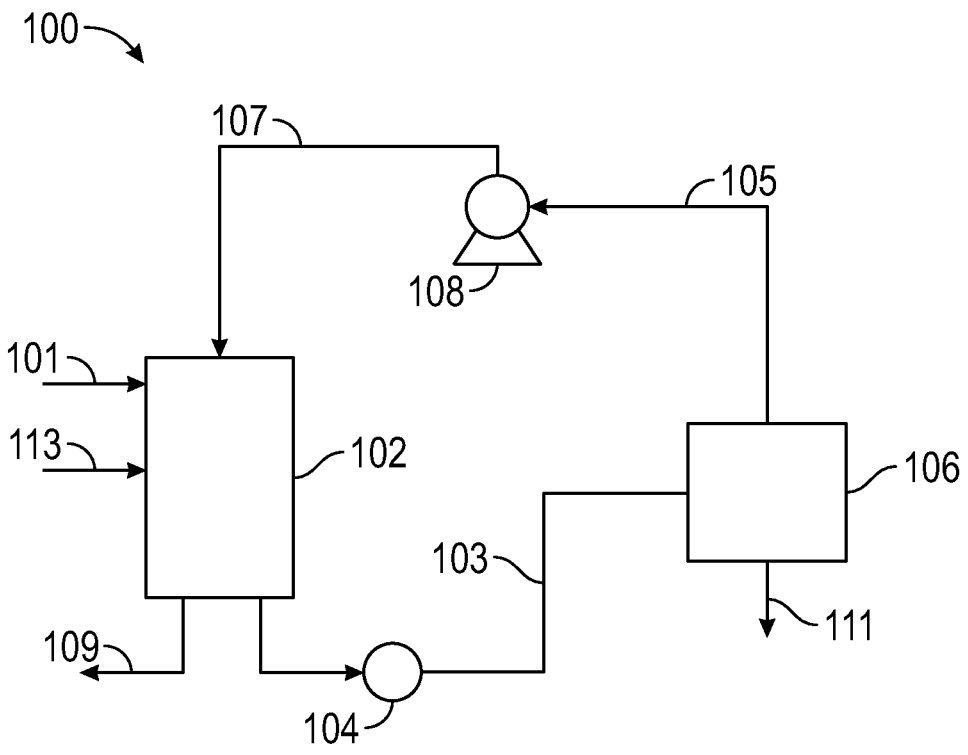
FIG. 1 is a schematic illustration of a system in accordance with embodiments disclosed herein.

Embodiments disclosed herein relate to systems and methods for extracting contaminants, such as hydrocarbons from drill cuttings. Specifically, embodiments disclosed herein relate to systems and methods for removing hydrocarbons from a surface and/or pores of drill cuttings, for example, removing residual hydrocarbons from the surface of the drill cuttings after the drill cuttings have been bulk separated from drilling fluid. Further, embodiments disclosed herein relate to systems and methods for determining when a desired extraction level of hydrocarbons has been reached during processing of contaminated drill cuttings. Further, embodiments disclosed herein relate to continuous and periodic monitoring of extracted drill cuttings fluid.

Systems and methods for removing contaminants from drill cuttings may include contacting contaminated drill cuttings with an expandable solvent, such as an expandable liquid solvent, a near critical, or supercritical solvent. Expandable solvents, as used herein, refers to compounds or compositions that may have an affinity for contaminants when at an elevated pressure, but whose affinity for the contaminants may be decreased when at a decreased pressure, allowing separation of the contaminants from the solvent. For example, carbon dioxide may be used to dissolve or extract contaminants from drill cuttings when in a liquid or supercritical fluid state, and expansion of the carbon dioxide to a gaseous state may readily separate the contaminants from the carbon dioxide. Other expandable solvents that may be used for removal of contaminants from drill cuttings may include ethane, propane, and natural gas for example, which have a relatively high miscibility with heavier hydrocarbons when at high pressure, and may be readily separated from the heavier hydrocarbons by a change in pressure. Other suitable expandable solvents may include, for example, liquid nitrogen, the handling of which may be more difficult to store and may cause safety concerns in the field compared to carbon dioxide.

During contact with the contaminated drill cuttings, the expandable solvent may extract and/or dissolve contaminants away from the drill cuttings, cleaning the drill cuttings. When the cuttings are substantially "clean," they may be recovered and disposed of, such as by landfill or other environmentally friendly disposal methods. As used herein, "clean" or "substantially clean" drill cuttings refers to the cuttings having a residual contaminant level below 1% by weight.

Processes for removing contaminants from drill cuttings may be performed cyclically. For example, a batch of drill cuttings may be loaded into an extraction system according to embodiments herein, cleaned, and discharged from the extraction system, which may then be prepared for the next batch of drill cuttings.

Control of the operation of the extraction system is not akin to other cyclical operations. In many cyclical operations, such as a pressure swing adsorption system for purifying a gas, the system may be operated with specifically timed cycles. However, the drilling process may encounter varying types of formations, such as sands, silts, clays, shales, and other rocky formations, each of which may have differing affinities for contaminants, and the drilling process may use multiple types of drilling muds, thus varying the types of contaminants that may be on the drill cuttings. Thus, it is desired to contact the drill cuttings with the expandable solvent for a time sufficient to remove the contaminants to a desired level; but it is also desired to ensure that the contact time is not excessively long, i.e., contacting but no longer effectively cleaning the drill cuttings. The drill cuttings contaminant removal process should be dynamically adaptive, meeting the demands of the multiple variables encountered as a result of drilling processes.

Measuring the actual level of contaminants on the drill cuttings during the cleaning process is difficult, as in situ measurement of the drill cuttings themselves cannot readily be performed, and ex situ measurement would be overly time consuming. In contrast to direct measurement of the drill cuttings contaminant level, the target objective, embodiments herein utilize indirect measurement techniques to determine when the drill cuttings cleaning process is complete, returning a substantially clean drill cuttings suitable for disposal, and ensuring the extraction cycle time is not excessive. In some embodiments, the indirect measurement techniques may measure a property, such as the viscosity of the expandable solvent/contaminant mixture (extraction vessel effluent). In other embodiments, the indirect measurement technique may analyze the expandable solvent/contaminant mixture (extraction vessel effluent) by Fourier Transform InfraRed (FTIR) spectroscopy.

Drill cuttings contaminant removal processes disclosed herein utilize an extractant, i.e., an expandable solvent, and a measurement device to determine a length of time for extracting hydrocarbons from drill cuttings. Measurement devices may include, for example, viscometers and/or gas chromatography/mass spectrometry ("GC"/"MS") systems, among others. The measurement device may be used to measure a property, such as a viscosity or a composition, of an effluent from a drill cuttings cleaning vessel, where the effluent includes the extractant and a portion of the contaminants, which may include heavier hydrocarbons, such as diesel range hydrocarbons, surfactants, emulsifying agents, and other drilling fluid additives known to those in the art. The measured property of the effluent may indirectly indicate the extent to which contaminants have been removed from the drill cuttings.

As an example, in some embodiments, pure liquid or supercritical carbon dioxide has a certain viscosity at a given temperature and pressure. The viscosity of the effluent, which may contain heavier hydrocarbon contaminants, may be higher than that for pure carbon dioxide. The viscosity of the effluent is thus indicative of the contaminant removal, where a relatively higher viscosity may indicate a high effluent contaminant content, and a relatively lower viscosity may indicate a low effluent contaminant content. The viscosity may thus indicate when the contaminant removal process should continue, e.g., at high relative viscosities, and when the contaminant removal process may be terminated, e.g., at low relative viscosities. A viscometer, for example, may thus be used to continuously or intermittently measure a property, such as the viscosity, of the effluent to effectively control a cycle time of the process.

In other embodiments, pure liquid or supercritical carbon dioxide has a certain FTIR spectrum at a given temperature and pressure. The effluent, which may contain heavier hydrocarbon contaminants for example, may have a different FTIR spectrum than that for pure carbon dioxide. The FTIR spectrum of the effluent is thus indicative of the contaminant removal. The FTIR measurement may thus indicate when the contaminant removal process should continue and when the contaminant removal process may be terminated. An FTIR spectrometer for example, may thus be used to continuously or intermittently measure a property, such as the spectrum, of the effluent to effectively control a cycle time of the process.

As mentioned above, expandable solvents useful in embodiments herein may include carbon dioxide, among others. Carbon dioxide (CO2) is a widely used supercritical fluid having a critical temperature of about 31° C. and a critical pressure of about 74 bar. The properties of a supercritical fluid can be altered by varying the pressure and temperature, allowing selective extraction and the ability to readily separate the solvent from the solute by adjusting temperature and/or pressure. In other embodiments, liquid carbon dioxide ($LCO_2$) may be used as the expandable solvent, as the solvating power of liquid carbon dioxide may also be readily adjusted.

Generally, a system for removing contaminants from drill cuttings according to embodiments herein may include an extractant source, an extraction tank, a measurement device, a separation tank, a compressor, and transfer lines. Contaminated drill cuttings may be placed or loaded into an extraction tank, where an extractant may continuously flow through the extraction tank to extract the contaminants, such as hydrocarbons, from the drill cuttings. The mixture of the extracted contaminants and the extractant may flow through a transfer line to a separation tank. During transport, a measurement device may continuously or intermittently measure a property of the mixture indicative of the remaining contaminant content of the drill cuttings. Properties of the mixture may include viscosities, FTIR spectra and mixture compositions, for example.

In the separation tank, the mixture may be depressurized or expanded so as to alter the solvating power of the expandable solvent. The depressurization/expansion separates the contaminants from the extractant, which may now be in an expanded state, such as in vapor form due to the depressurization/expansion. From here, the separated contaminants may be recovered from the separation tank via various outlets and piping. The expanded extractant may then be transferred to a compressor or pump where it is re-pressurized or compressed for reuse as an extractant. For example vapor carbon dioxide may be transformed into a liquid or to a supercritical fluid to achieve the desired solvating power of the expandable solvent, and the extractant may then be returned to the extraction tank as a recycled extractant for use in further extractions of contaminants from drill cuttings.

The extraction process may continue until the drill cuttings are sufficiently cleaned of contaminants, where the measurement device provides an indication of the remaining contaminant level on the drill cuttings, as will be discussed further below. Drill cuttings in the extraction tank may then be removed or discharged from the extraction tank. A reduction in extraction time from, e.g., 1.5 hours when running the extraction process blindly as opposed to 45 minutes when using embodiments disclosed here, may result in a $20-22 per ton of savings.

FIG. 1 illustrates a system 100 for extracting contaminants from drill cuttings in accordance with embodiments disclosed herein. While described below with respect to liquid carbon dioxide, the system may also be used with supercritical carbon dioxide or other solvents as noted above.

System 100 may include a fresh or make-up carbon dioxide source (not shown), extraction tank vessel 102, measurement device 104, separation tank vessel 106, compressor or pump 108, and transfer lines 101, 103, 105, 107, 109, 111 and 113.

The system 100 may include an extraction tank vessel 102 fluidly connected to an extractant source (not shown) via line 101. The extractant source may supply $LCO_2$, or another extractant, to the extraction tank vessel 102 at a pressure ranging from about 45 bar to about 75 bar and temperature ranging from about 10° C. to about 30° C., for example. The extractant source may supply $LCO_2$ to the extraction tank vessel 102 at a pressure ranging from about 55 bar to about 65 bar and temperature ranging from 15° C. to about 25° C. In other embodiments, the extraction tank vessel 102 is also fluidly connected to a source of contaminated drill cuttings (not shown, such as shale shakers, troughs, tanks or containers used to hold drill cuttings) via a flow line 113.

The extraction tank vessel 102 is any vessel capable of holding contaminated drill cuttings and having an extractant passed therethrough, and should be capable of withstanding the elevated pressures, including at lower temperatures as may be encountered when the vessel is depressurized.

Extraction tank volume, $LCO_2$ temperatures, extraction tank pressures, flow rates of $LCO_2$ into the extraction tank vessel 102, etc., should be sufficient for the size of operation, and should provide sufficient resident time in the extraction tank for the extractant, such as $LCO_2$, to solubilize hydrocarbons and other contaminants in the extraction tank. For example, at extraction tank conditions of 18° C. and 60 bar, an $LCO_2$ flow rate in the range of 900 g/min to 1500 g/min has been found to be effective for removing contaminants from a 10 L extraction tank filled with approximately 12 kg of drill cuttings. Flow rates may be different for larger or smaller extraction tanks, as well as for different extraction pressures and temperatures.

As noted above, the extraction may be performed in some embodiments with an expandable solvent that is a liquid or that is a supercritical fluid. Accordingly, in various embodiments, the extraction tank vessel 102 may be operated at pressures within a range from about 40 bar to 90 bar, such as in the range from 50 bar to 85 bar, or from about 55 bar to 75 bar. When operating with $LCO_2$, pressures from about 40 bar to about 65 bar may be used, and when operating with $SCCO_2$, pressures of greater than 75 bar may be used. Further, in various embodiments, the extraction tank vessel 102 may be operated at temperatures within a range from about 10° C. to about 50° C., such as from about 15° C. to about 30° C. for $LCO_2$, and from about 32° C. to about 40° C. for $SCCO_2$. For other expandable solvents, pressures and temperatures may be selected as appropriate or readily determinable by a person having ordinary skill in the art.

The system 100 also includes a measurement device 104 in transfer line 103, or fluidly connected to transfer line 103, which fluidly connects the extraction tank vessel 102 to a separation tank vessel 106. As the effluent from the extraction tank vessel 102 is passed via flow line 103 from extraction tank vessel 102 to separation tank vessel 106, the measurement device 104 may measure a property of the effluent, such as liquid $CO_2$ admixed with contaminants. In some embodiments, a filter (not shown) may be installed upstream of the measuring device 104, between the extraction tank and separation tank, to filter out solids that may be entrained in the extractant, such that the solids do not pass through the measuring device 104.

In some embodiments, the measurement device 104 may be a viscometer. A viscometer is an instrument which measures the viscosity of a fluid. In general, either the fluid remains stationary and an object moves through the fluid, or the object is stationary and the fluid moves past the object. The drag caused by the relative motion of the fluid and a surface of the object allows measurement of the viscosity of the fluid.

The viscometer should be rated for the operating pressure and temperature of the effluent, and should be calibrated to encompass the pure expandable solvent and a saturated expandable solvent. For example, for $LCO_2$, the viscometer may be calibrated to measure absolute viscosities in the range from about 0.1 cP to about 4.0 cP. In other embodiments, viscometers may not be available that encompass the entirety of the viscosity range over which the extraction tank effluent may operate. In such embodiments, multiple viscometers may be configured in series or parallel to cover the total range of viscosity. For example, a first viscometer may have an operating range of 0.02 cP to 2.0 cP, and a second viscometer may have an operating range of 2.0 cP to 10.0 cP. In such an instance, the multiple viscometers may be used to ascertain the actual viscosity of the effluent for the desired process control. When used, control systems may be programmed to account for the multiple viscometers, such that a determination is made as to which viscometer is providing a true reading.

The viscometer may be, but not limited to, U-tube or capillary viscometers, falling sphere viscometers, falling piston viscometers, oscillating piston viscometers, vibrational viscometers, rotational viscometers, electromagnetically spinning sphere viscometers, Stabinger viscometers, bubble viscometers, dynamic, and micro-slit viscometers. In some embodiments, the viscometer may be a Cambridge Viscometer Model CV2000 (Medford, Mass.).

In other embodiments, the measurement device 104 may be an FTIR sensor. Fourier Transfer InfraRed ("FTIR") is a technique which is used to obtain an infrared spectrum of absorption, emission, photoconductivity or Raman scattering of a solid, liquid or gas. An FTIR spectrometer simultaneously collects spectral data in a wide spectral range and measures how well a sample absorbs light at each wavelength. This technique shines a beam containing many frequencies of light at once, and measures how much of that beam is absorbed by the sample. Next, the beam is modified to contain a different combination of frequencies, giving a second data point. This process is repeated many times. Afterwards, a computer takes all these data and works backwards to infer what the absorption is at each wavelength. The transmitted light through the sample is compared with light transmitted by an identical cell containing just solvent. The IR transmittance spectrum T is defined as the percentage of the light intensity of a sample (IS) over the light intensity of a reference (IR) such as $T\%=100 \cdot IS/IR$ and the absorbance A measured in absorbance units A.U. is $A=-\log 10T$. The major factor that determines the peak intensity in infrared spectra is the concentration of molecules in the sample which can be described by Beer's law.

The separation tank vessel 106 may be any vessel capable of withstanding pressures of about 45 bar to about 90 bar (for example, averaging 55 bar), at depressurization temperatures. Following transport via flow line 103 from measurement device 104 to separation tank vessel 106, the expandable fluid may be depressurized, such as across a control valve (not shown), decreasing the solvating power of the expandable solvent and allowing separation of the contaminants from the expandable solvent, such as by density or gravity separations. For example, the separation tank vessel 106 may receive and expand the effluent from extraction tank vessel 102, where expansion causes the $LCO_2$ to vaporize, leaving hydrocarbons behind in the separation tank vessel 106. The $CO_2$ may then be recovered via flow line 105 and the contaminants may be continuously or intermittently recovered via flow line 111.

The separation tank vessel 106 is fluidly connected to the pump or compressor 108 via transfer line 105. Expanded solvent recovered from separation tank vessel 106 may be re-pressurized for reuse in extraction tank vessel 102 via pump or compressor 108 via flow line 107. Depending upon the extent of vaporization and the resulting temperature drop, the expandable solvent may be heated prior to or after compression, thus providing the fluid to the extraction tank vessel 102 at the desired temperature.

A method of cleaning contaminated drill cuttings, using the system 100 may include placing or loading an amount of contaminated drill cuttings, e.g., drill cuttings with hydrocarbons, in extraction tank vessel 102 via flow line 113. The contaminated drill cuttings may be placed in the extraction tank vessel 102 through lines from the shale shakers or drill cuttings containers, or they may be gathered through other means, without the use of transfer lines, and placed into the extraction tank. After placement of the contaminated cuttings in the extraction tank vessel 102, the extraction tank vessel 102 may be prepared for the cleaning operation, such as by adjusting valving, etc.

A flow of expandable solvent from pump or compressor 108 may be introduced to the extraction tank vessel 102 via flow line 107. In some embodiments, fresh or makeup expandable solvent may also be introduced to the extraction tank vessel 102 via flow line 101. Alternatively, fresh expandable solvent may be added upstream of the separation tank vessel 106 or upstream of the compressor 108, depending on the supply pressure of the expandable solvent. Initially, the pressure in the extraction tank vessel 102 will build (low pressure when loading to high pressure for extraction), and when at operating pressure, a continuous flow of expandable solvent through the extraction tank vessel 102 may commence.

After exposing the drill cuttings to the expandable solvent, such as liquid carbon dioxide, the contaminants, such as hydrocarbons, solubilize off the contaminated drill cuttings and form a mixture with the expandable solvent. The mixture may be transferred via transfer line 103 through a measurement device 104, which may measure a property of the effluent.

The measurement device 104 may continuously monitor the extracted fluid, or may make periodic measurements. The continuous monitoring may allow the cuttings cleaning process to run uninterrupted, i.e., the extraction process may not have to be suspended or halted in order to determine that the cuttings contaminant content satisfies regulatory standards or user/customer standards.

The measured property of the mixture may be used to directly or indirectly determine a contaminant content of the effluent. Initially, the contaminant level in the extraction tank vessel effluent will be high, such as saturated or close to saturation, extracting readily available contaminants from the cuttings. As the cuttings become cleaner, the contaminant level in the extraction tank vessel effluent may decrease, as the contaminants may be harder to extract or may take additional residence time to extract, such as from within the pores of the cuttings or being less soluble in the expandable solvent than the contaminants extracted at earlier stages of the cleaning process.

As the cleaning process continues, the property measurement may fluctuate. For example, contaminant saturated $LCO_2$ may have a high viscosity, and as cleaning continues, the viscosity of the effluent from the extraction tank vessel 102 may decrease. As the cuttings cleaning process continues, the viscosity of the effluent may "flat line", being fairly constant or decreasing very slowly, but may still be greater than the viscosity of pure $LCO_2$, indicating that some contaminants are present in the effluent.

Given an infinite amount of time, the cuttings may be completely cleaned of contaminants. However, such is unrealistic, and an efficient way to determine when the cuttings are sufficiently clean for disposal is desired. As noted above, the character of the cuttings varies over the drilling process, and thus a set period of time is also not a viable option, as extracting for 60 minutes total could leave 5% contaminants on some cuttings and 0.5% contaminants on other cuttings. Embodiments herein provide for termination of the extraction process based on the property measurement, such as terminating at a given viscosity, or terminating at a time after property measurement "flat line." In other embodiments, the extraction may be terminated at an estimated cuttings contaminant level, such as via a correlation relating viscosity, time at viscosity "flat line," or other measured properties, to cuttings contaminant level. The correlation may account for the solvent and extraction conditions, the types of contaminants expected, as well as the type of cuttings (shale, clay, etc.) and their geomorphology.

In some embodiments, for example, based on the property measurement, an amount of contaminants remaining on the drill cuttings may be estimated or determined, such as by an algorithm for predicting the hydrocarbon content of the mixture. If the amount of contaminants remaining on the drill cuttings is determined to be less than a given allowed hydrocarbon content or value, such as 1 wt %, then processing of the contaminated drill cuttings may be terminated, i.e., terminating the exposure of drill cuttings to $LCO_2$. If the amount of hydrocarbons remaining on the contaminated drill cuttings is determined to be greater than a given allowed hydrocarbon content or value, then the processing of the contaminated drill cuttings may continue until a determination is made that the amount of hydrocarbons remaining is less than the given allowed hydrocarbon content or value. The given allowed hydrocarbon content or value may be set by regulation, customer, or user. A given allowed hydrocarbon content or value for the drill cuttings hydrocarbon content may be 1% by weight, for example. A 1% drill cuttings hydrocarbon content may correlate to a hydrocarbon concentration of approximately 750 parts per million of hydrocarbons/$LCO_2$ mixture, for example, such as for a given type of cuttings with a diesel contaminant.

The above was described with respect to measurement device 104 being a viscometer. In some embodiments, measurement device 104 may be a GC/MS, as noted above. As an alternative to viscosity, such as GC/MS for example, a 1 wt % drill cuttings hydrocarbon content for some cuttings types may correlate to a hydrocarbon concentration of approximately 750 parts per million in the effluent mixture. Thus, for certain cuttings, measurement device 104 may measure a contaminant concentration in the expandable solvent, and the extraction cycle time may be based on the concentration measurement, a time period following plateau of a concentration measurement, or a correlation between cuttings contaminant level and effluent contaminant concentration, similar to viscosity as described above. While absolute concentration or a time period following plateau approximate a concentration may be effective, due to the varying nature of the cuttings and contaminants, correlations that take into account varying factors may provide process control achieving sufficiently clean cuttings more effectively and efficiently.

Figure 2:
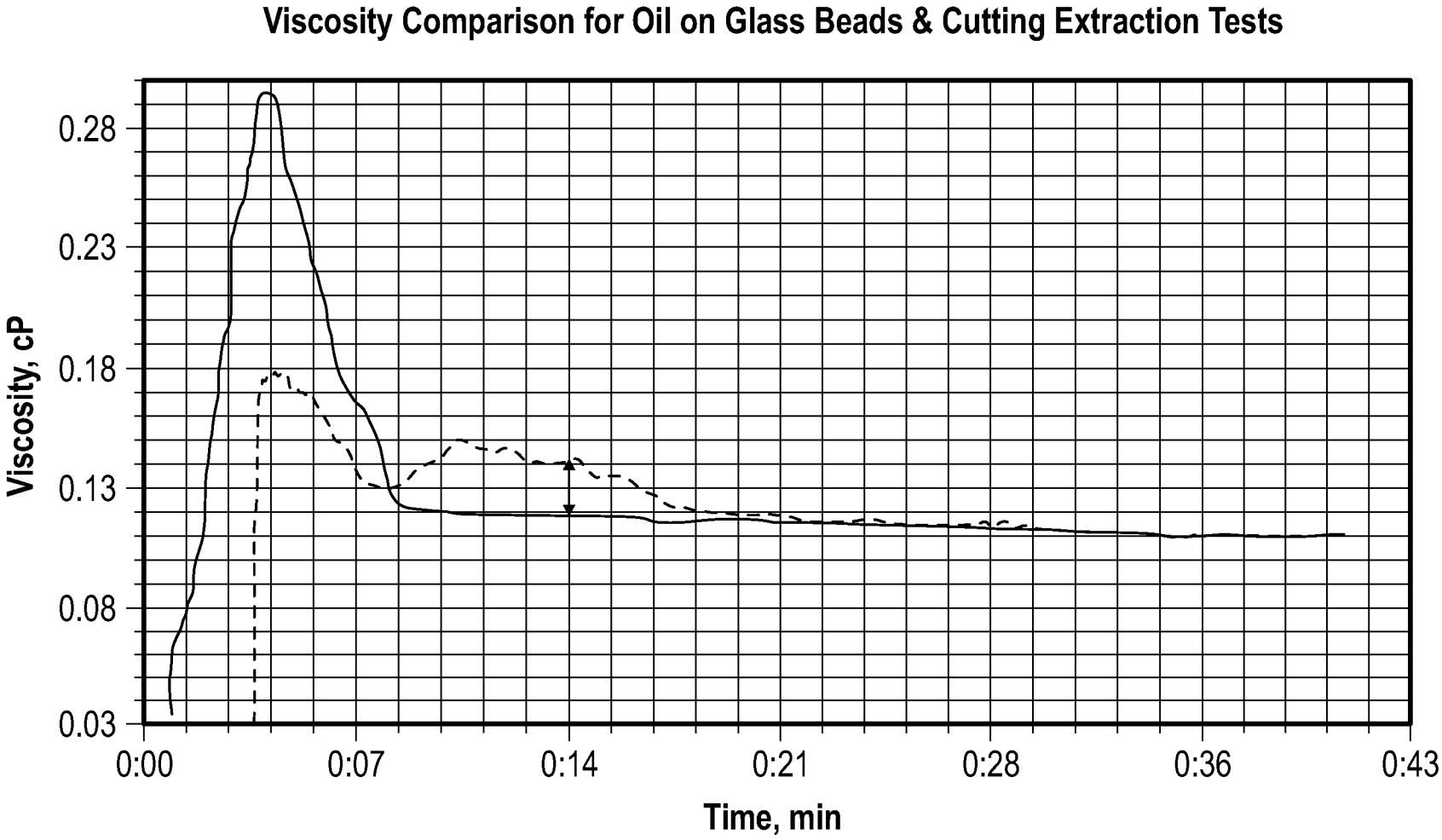
FIG. 2 shows viscosity curves for liquid carbon dioxide ($LCO_2$)/contaminant mixtures.

Contaminants are at a higher initial concentration in the cuttings, and as the extraction process continues, the contaminant level on the cuttings decreases, resulting in less and less extractable or soluble contaminants remaining or contaminants deeper in the pores of the cuttings. Accordingly, the measured effluent property may indicate a high contaminant removal, and then will continue to decrease until the majority of contaminants are removed. However, the measured effluent property may decrease quite slowly after a certain point (i.e., the viscosity curve may start to plateau, i.e., the law of diminishing returns, as shown in FIG. 2, for example). This plateau of the measured effluent property may indicate steady state or a pseudo steady state of the effluent mixture.

As noted above, reaching a measurement plateau does not guarantee that the cuttings are clean. For example, in certain embodiments, 14 minutes after the measured effluent property starts to plateau has been found to be a terminating point for the extraction process, providing for the cuttings to have reached 1 wt % contaminant levels, where stopping the extraction process at the start of the plateau may result in unacceptably high levels of contaminants remaining on the cuttings. In various embodiments, the termination time (time continuing extraction after reaching plateau) may be in the range from 5 minutes to 90 minutes, such as from about 10 minutes to about 30 minutes, depending upon the contaminant type and cuttings type, among other variables. A person having ordinary skill in the art understands that time ranges may vary due to various factors, such as the amount of cuttings, the size of the extraction tank, the amount of hydrocarbons on the cuttings, type of solvent, flow rate of solvent, pressure in the extraction tank, and temperature of the solvent etc.

For example, it has been found that for 12 kg of drill cuttings with about 12% hydrocarbon content placed in a 10 L extraction tank with an $LCO_2$ flow rate of 1200 grams per minute, the extraction process took about 14 minutes of plateau time to reduce the hydrocarbon content to below 1 wt %. The pressure in the extraction tank was about 60 bar and the temperature was about 18° C. Other cuttings may perform differently, and may take longer or shorter plateau extraction time to be sufficiently cleaned.

In some embodiments, the extraction time may be based on the start of the measurement plateau. For example, a given cuttings/contaminant mixture may be sufficiently cleaned at 30 minutes of plateau extraction time. Accordingly, the cuttings cleaning process is started, measured effluent property increases, then decreases. Once a plateau is reached, the process may be terminated a given time period after reaching the plateau, such as 30 minutes after reaching plateau. In this manner, the cuttings process does not extend for an overly extensive, non-productive cleaning period after the cuttings are sufficiently clean.

In certain embodiments, a system controller may be connected to the measuring device 104 to receive measurement data, such as viscosity. The system controller may use the measured effluent property to determine drill cuttings contaminant content via an algorithm derived from correlation data of measured effluent property and contaminant content as disclosed in the "Examples" section below. The system controller may output a notification to an operator of the extraction process. This notification may include various extraction process data at any point in time within an extraction cycle time, and the notification may include instructions to terminate the extraction process or that the cuttings contaminant level has decreased below a target level. The drill cuttings cleaning process may terminate or continue, instantaneously, based on real time notifications of the contaminant content of the drill cuttings.

This notification of various extraction process data may be in audio or visual form. The notification may be outputted to a display for review by an operator of the extraction process. The various extraction process data may include data such as mixture viscosity, mixture hydrocarbon content, extraction time, time until 1 wt % contaminant content for the drill cuttings, initial drill cuttings hydrocarbon content, extraction and separation tank size, extraction and separation tank pressures and temperatures, solvent type, and solvent flow rates.

The operator may choose to terminate or continue the extraction process based on the notification. In some embodiments, the extraction process may be fully automated where the system controller automatically shuts the extraction process down after achieving drill cuttings contaminant content to less than 1 wt %. For example, after the system controller determines that less than 1 wt % contaminant content has been achieved, it may terminate the influx of solvent into the extraction tank by closing entry valves to the extraction tank. The system controller may then route the solvent remaining in the extraction tank, separation tank, and transfer lines, back to its source, or containment tank via transfer lines. The system controller may then evacuate the extraction tank of the "clean" drill cuttings via various methods such as outlets, valves, piping, pumps, augers, conveyor belts, or the drill cuttings may be manually removed. In some embodiments, the expandable solvent, such as $CO_2$, may be used as a transport medium to effectuate transfer of the cleaned cuttings from the extraction vessel to a cleaned cuttings holding vessel, for example. If the hydrocarbon content is not less than 1%, the system controller may continue the process until the hydrocarbon content is less than 1%.

In other embodiments, in addition to or alternatively to the measuring device 104 a second measurement device (not shown) may monitor the contents of the separation tank vessel 106. In some embodiments, the second measurement device may be a level indicator for monitoring the level of the hydrocarbons in the separation tank vessel 106 after expansion of the expandable solvent. Once the level of hydrocarbons in the separation tank vessel 106 plateaus, the operator may stop the process or allow the process to continue a set amount of time before stopping the process to ensure adequate removal of the hydrocarbons from the cuttings.

The "Examples" section provided below provides additional details regarding the above-described process.

EXAMPLES

Three exemplary approaches for determining efficacy of a viscometer used to monitor the cuttings cleaning process and stop the process when the drill cuttings hydrocarbon content falls below 1 wt % in accordance with embodiments described herein are described below. Without such monitoring and control, the cuttings cleaning process may run significantly longer, or intuitively. A system controller as discussed above may be implemented with the following three approaches and experiments. This implementation may allow for an efficient and cost effective hydrocarbon extraction process for contaminated drill cuttings.

Approach 1:

Difference in Viscosities Calculation. Glass beads contaminated with diesel were placed in a 10 L extraction unit and had hydrocarbons extracted with liquid carbon dioxide. The same was done with drill cuttings contaminated with diesel.

The viscosities for diesel on glass beads with $LCO_2$, and diesel on drill cuttings with $LCO_2$ were measured. A trial-and-error procedure or a linear regression approach was used to define the viscosity difference value corresponding to 1 wt % of hydrocarbons in the cuttings. FIG. 2 shows viscosity curves for hydrocarbons on beads and cuttings represented as upper and lower curves, respectively. The difference in viscosity lines would be proportional to the hydrocarbon content of a sample of drill cuttings, e.g. 3%, taken at about 14 minutes. A system controller implemented into the extraction process may determine drill cuttings hydrocarbon content by using an algorithm based on correlations of viscosity to hydrocarbon content, and then may output this information to an operator of the extraction process.

Approach 2:

Time of Plateau (steady state, pseudo steady state). A time of plateau for viscosity measurements may be a factor in determining when to terminate the cuttings cleaning process. The cuttings cleaning process was periodically stopped, for example, at 3, 5, 8, 12, and 15 minutes after the viscosity starts to plateau in order to analyze a sample of cuttings for its hydrocarbon content. This plateau may be described as steady state, or pseudo steady state. For a 10 L SFE unit, the plateau may occur within the first 30 min from the beginning of extraction. A trial-and-error procedure or a linear regression approach may determine the time of a plateau corresponding to 1 wt % hydrocarbon content. For example, the hydrocarbon content of a sample of drill cuttings taken at time of 30 minutes, shown in FIG. 2, may be 1.07%. A system controller implemented into the extraction process may determine sufficient plateau time periods for when the hydrocarbon content is less than 1 wt %. This information may then be used to continue or terminate the extraction process.

Approach 3:

A system controller may be implemented into the extraction process, and may use a mathematical algorithm to determine when the drill cuttings hydrocarbon content is less than a maximum allowed value. This algorithm may be based on a combination of test data and one of the existing temperature-viscosity models, such as Walther, Wright, Seeton, Briggs, etc. The mass flow rate of hydrocarbons in $LCO_2$ changes depending on the cuttings geomorphology and mixer rotational speed even though the mass flow rate of $LCO_2$ remains constant. As such, a series of empirical absolute viscosity baselines for a range of temperatures, pressures, cuttings type and contaminant concentrations in $LCO_2$ stream may be generated and used for development of the above-mentioned mathematical algorithms.

Extraction Process.

The process (using a 10 L extraction vessel) was experimentally used on 2 types of media during separate tests: 1) Bead Test, 5 lbs of ½-inch round glass beads and 1 L of diesel, 2) Drill Cuttings test, 12 kg of drill cuttings and 1 L of diesel. Three types of drill cuttings were used for the drill cuttings tests. The hydrocarbon contents for Type 1 drill cuttings, Type 2 drill cuttings, and Type 3 drill cuttings were 10.71%, 14.36%, and 11.44%, respectively. The average hydrocarbon content of the 3 types of drill cuttings was 12.2%. In the process, as shown in FIG. 1, $LCO_2$ was delivered to the 2 types of media, drill cuttings and beads, at a flow rate of about 1200 g/min, and the extraction tank was pressurized at approximately 60-65 bar.

Bead Tests.

Figure 3:
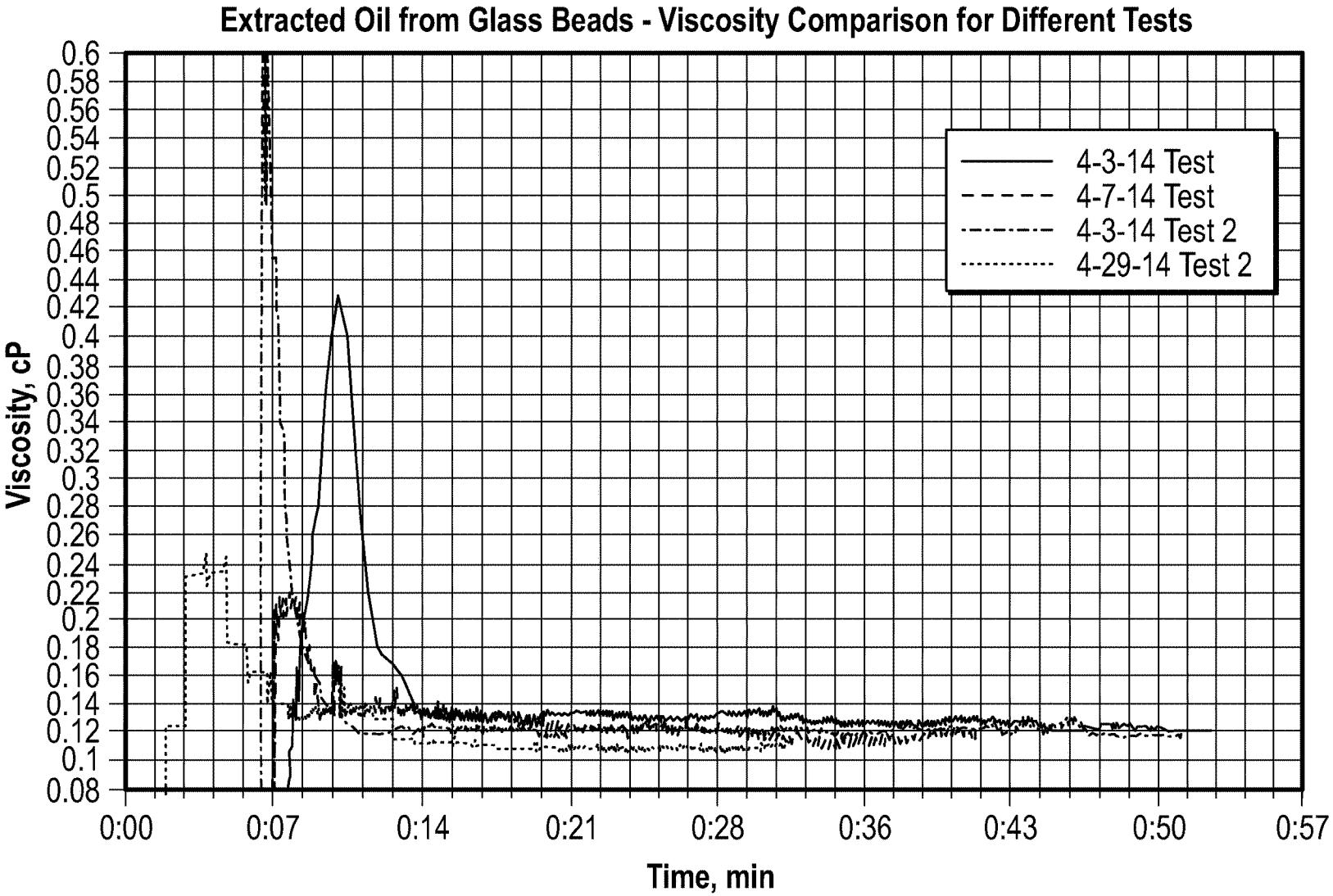
FIG. 3 shows several viscosity curves for glass beads tests.
Figure 4:
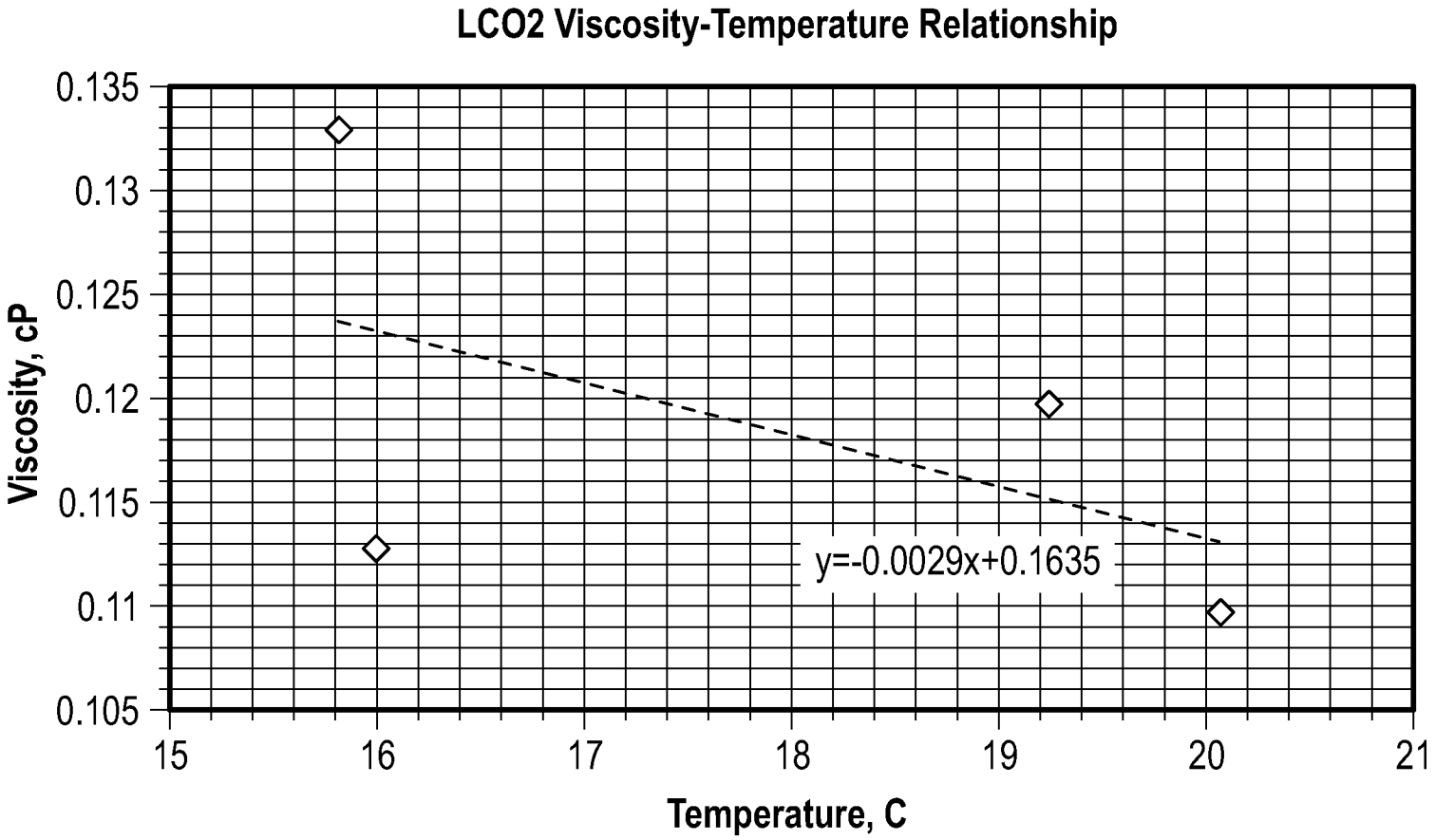
FIG. 4 shows a viscosity and temperature relationship.

Bead Tests were used to simulate hydrocarbon extraction from drill cuttings. In these tests, 5 lbs of ½ inch round glass beads and 1 L of diesel were exposed to $LCO_2$ (flow rate 1200 g/min). Based on peak and plateau times, as shown in FIG. 3, the diesel from smooth round glass beads can be extracted within about 14 minutes. On average, it may takes about 5-6 minutes to fill the extraction tank with $LCO_2$. After about 40 minutes of extraction, when the temperatures equalize, the viscosity converges to about 0.115 cP. The temperature and viscosity relationship for the beads tests was analyzed. Table 1 and FIG. 4 show the viscosity and temperature data of the mixture during its steady state. From time 14 min to 40 min, the viscosity readings deviate around this value by 5-10% due to differences in process temperature.

TABLE 1

Test results for the Bead tests

| Test | Temp., Celsius | Viscosity, cP |
|---|---|---|
| Bead Test #1 | 20.05 | 0.11 |
| Bead Test #2 | 19.23 | 0.12 |
| Bead Test #3 | 15.83 | 0.133 |
| Bead Test #4 | 16.0 | 0.113 |

Cuttings Type 1 Test.

Figure 5:
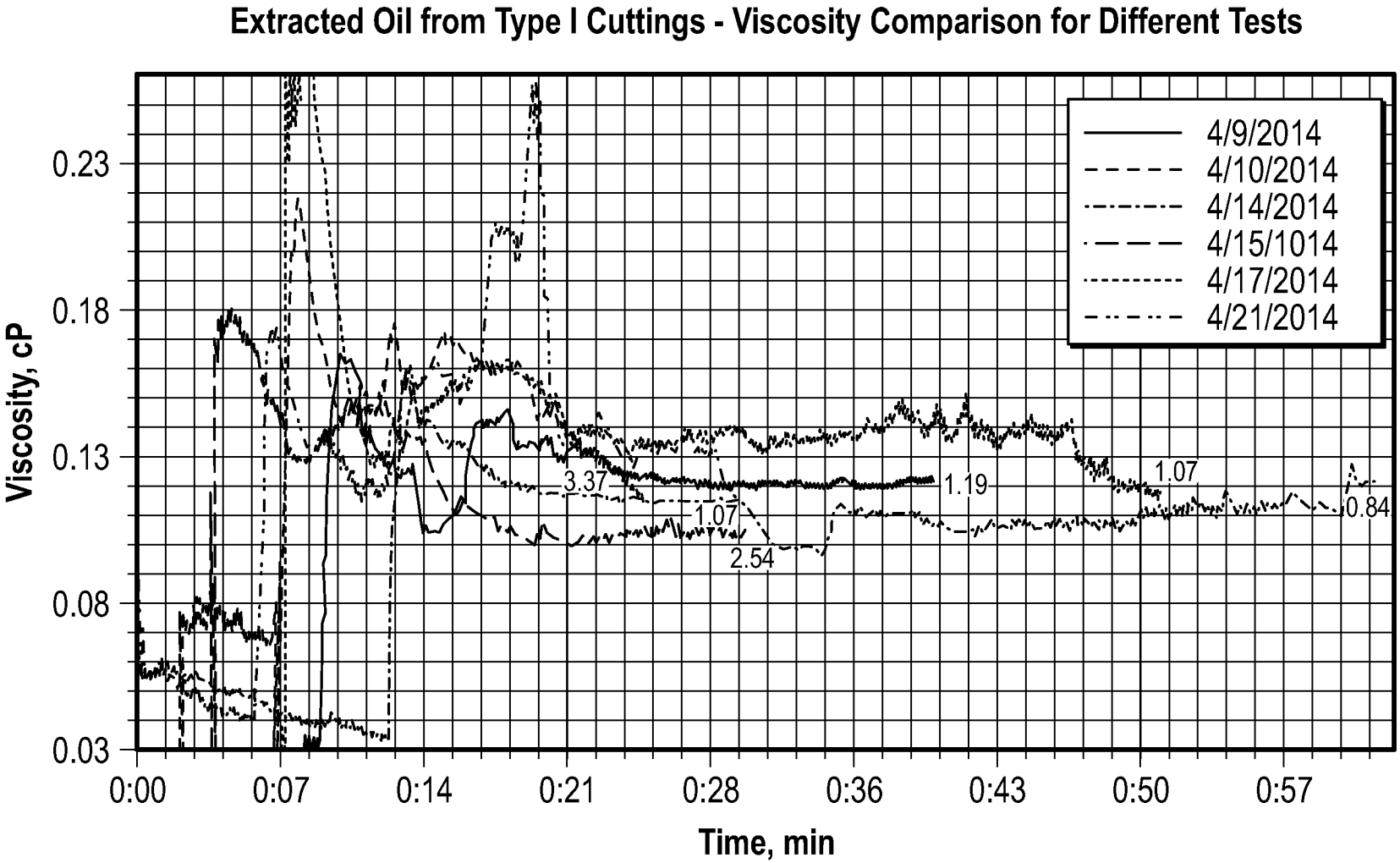
FIG. 5 shows viscosity comparisons for cuttings with 10.71% hydrocarbon content.

The tests results done on Type 1 cuttings (Inland Environmental) are shown in FIG. 5. The corresponding diesel contents of the cuttings samples are shown at the end of the viscosity curves. The general pattern is that the longer both the test duration and the plateau, the smaller the drill cutting hydrocarbon content. As in the beads case, the viscosity lines tend to converge to 0.115 cP+/−10% indicating slight process temperature fluctuations between the tests.

Cuttings Type 2 Test.

Figure 6:
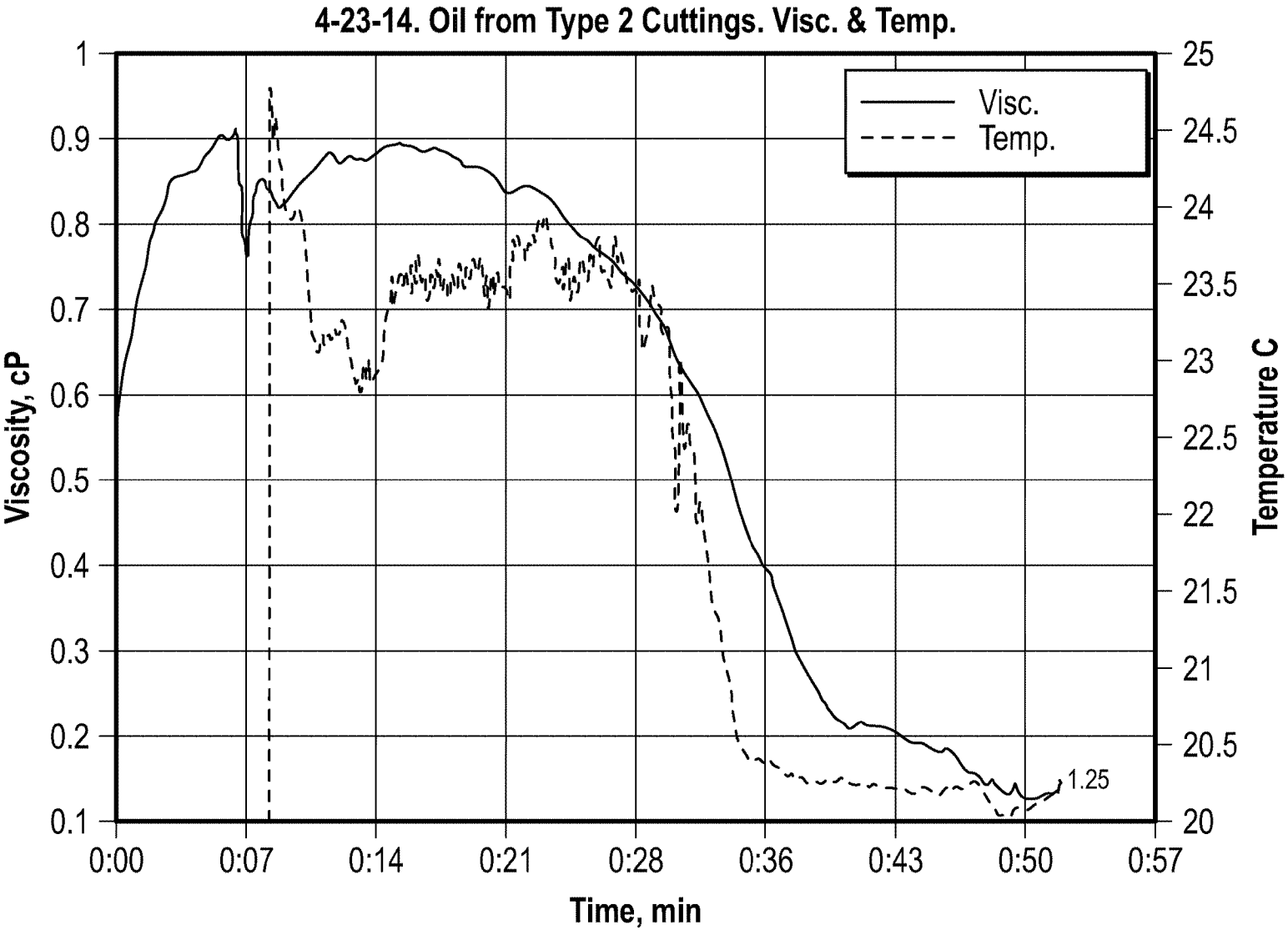
FIG. 6 shows the viscosity and temperature relationship for cuttings with 14.36% hydrocarbon content.

FIG. 6 shows the viscosity and temperature relationship for cuttings with 14.36% hydrocarbon content. The temperature curve shows that the relationship between the extracted mixture viscosity and process temperature, if any, may not be readily described.

Cuttings Type 3 Test.

Figure 7:
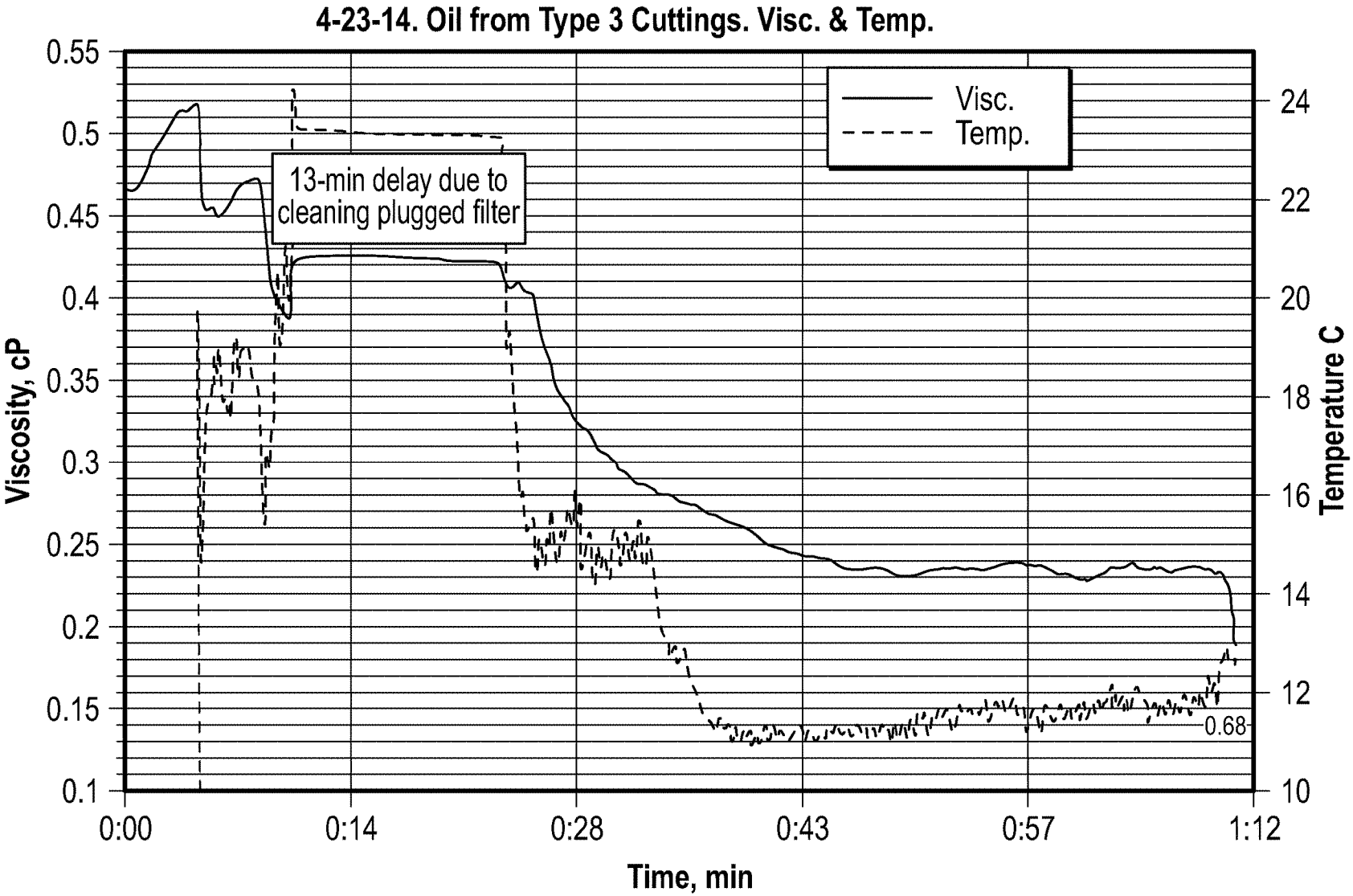
FIG. 7 shows the viscosity and temperature relationship for cuttings with 11.44% hydrocarbon content.

The rest of the cuttings remaining after Cuttings Type Test 2 were mixed with Type 1 cuttings in the ratio of 4:1. The resulting diesel content is 11.44%. FIG. 7 shows the viscosity and temperature relationship for cuttings with 11.44% hydrocarbon content. There was a 13-min delay caused by cleaning a filter plug later followed by the viscometer plugging as well. This resulted in a negative viscosity line slope.

For the 3 cuttings tests, Table 2 was compiled in the same manner as Table 1. The $LCO_2$ absolute viscosity was calculated according to the equation, $y=-0.0025x+0.1635$, in FIG. 4.

mented into the extraction process to monitor and evaluate when less than 1% drill cuttings hydrocarbon content occurs.

Figure 9:
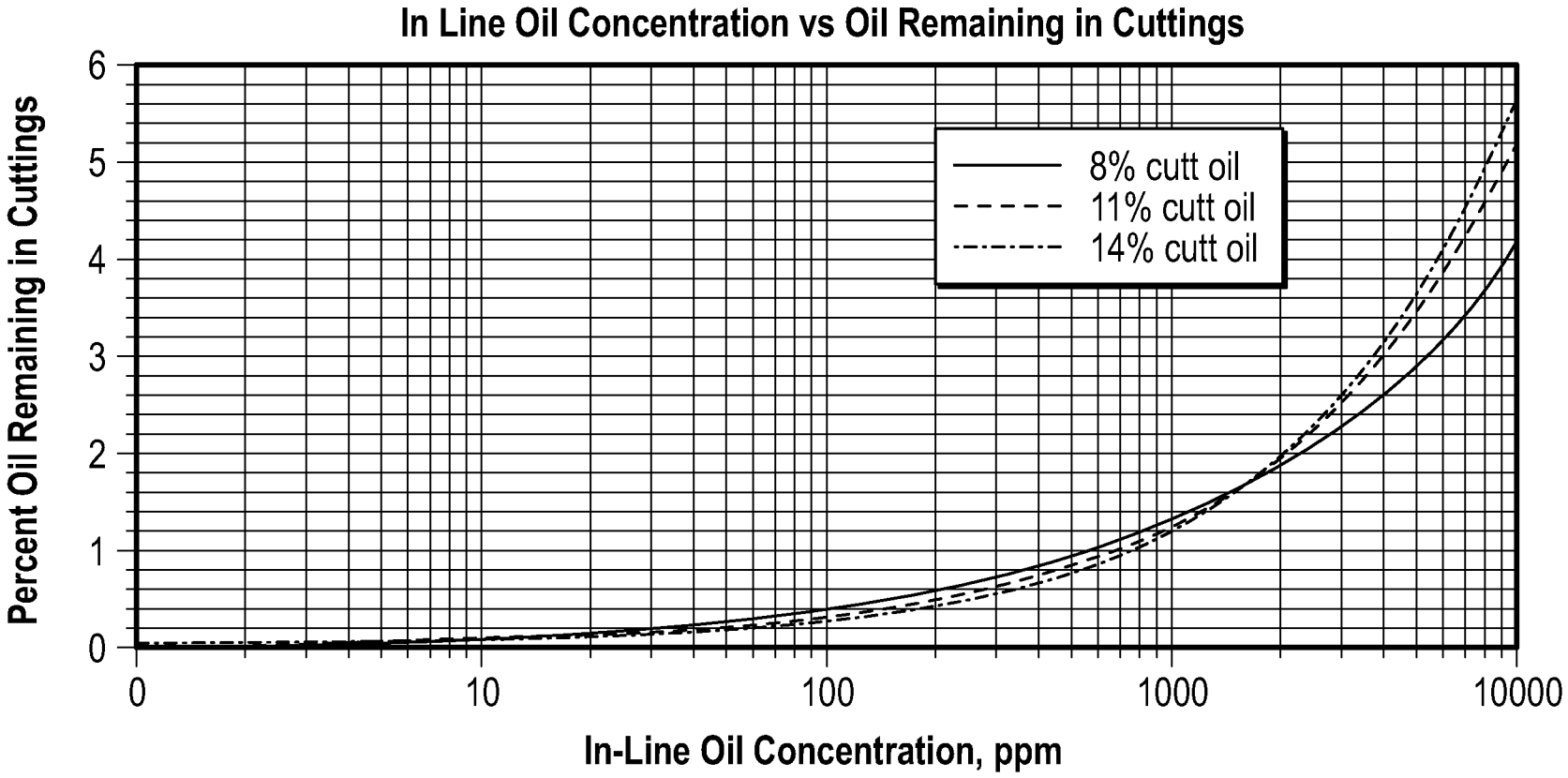
FIG. 9 shows hydrocarbon concentration vs. percentage of hydrocarbons remaining in drill cuttings for drill cuttings with an initial hydrocarbon content of 8%, 11%, and 14%.

Inline Hydrocarbon Concentration Determination:

Based on a 10 L cuttings cleaning unit study, the average predicted in line hydrocarbon concentration corresponding to 1 wt % hydrocarbons in drill cuttings for an initial average cuttings hydrocarbon content of 12.3 wt % was found to be 712 ppm as shown in FIG. 9. These tests indicate that a measurement device for measuring a concentration of contaminants in the extraction tank effluent, such as integrated with a system controller, may be implemented into the extraction process to monitor and evaluate hydrocarbon concentration via an algorithm based on viscosity and hydrocarbon content correlations.

Figure 10:
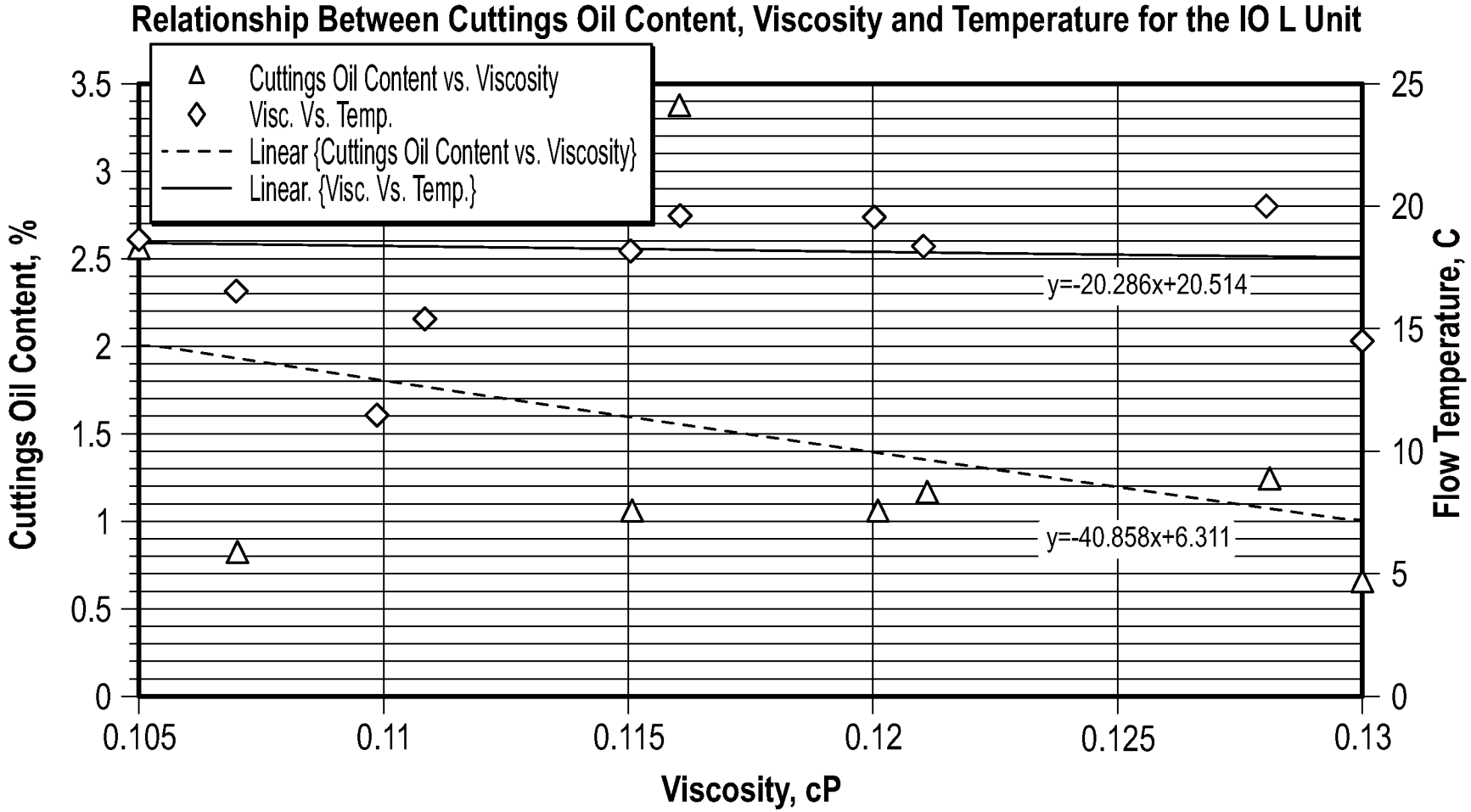
FIG. 10 shows the drill cuttings hydrocarbon content vs. viscosity and temperature.

FIG. 10 shows the drill cuttings hydrocarbon content vs. viscosity and temperature. The 1 wt % hydrocarbon content mark is at roughly 0.13 cP. The inline hydrocarbon concentration may be found by the following calculations: The theoretical $LCO_2$ viscosity at 18° C. and 60 bar is 0.072 cP. The diesel viscosity for density of 0.89 and 20° C. is 76.2 cP. The tested diesel density is 0.82. The average mixture temperature is 18° C. A viscosity approximation may be found by: $76.2 \cdot 20 \cdot 0.82/(18 \cdot 0.89)=78$ cP. The viscosity of $LCO_2$/hydrocarbon mixture for 1% cutting hydrocarbon content is 0.13 cP. The viscosity due to inline hydrocarbons may be found by: $0.13-0.072=0.058$ cP. The inline hydrocarbon concentration for 1% cutting hydrocarbon content may be found by: $0.058 \cdot 106/78=744$ ppm for an initial drill cuttings hydrocarbon content of 12.2%.

Figure 11:
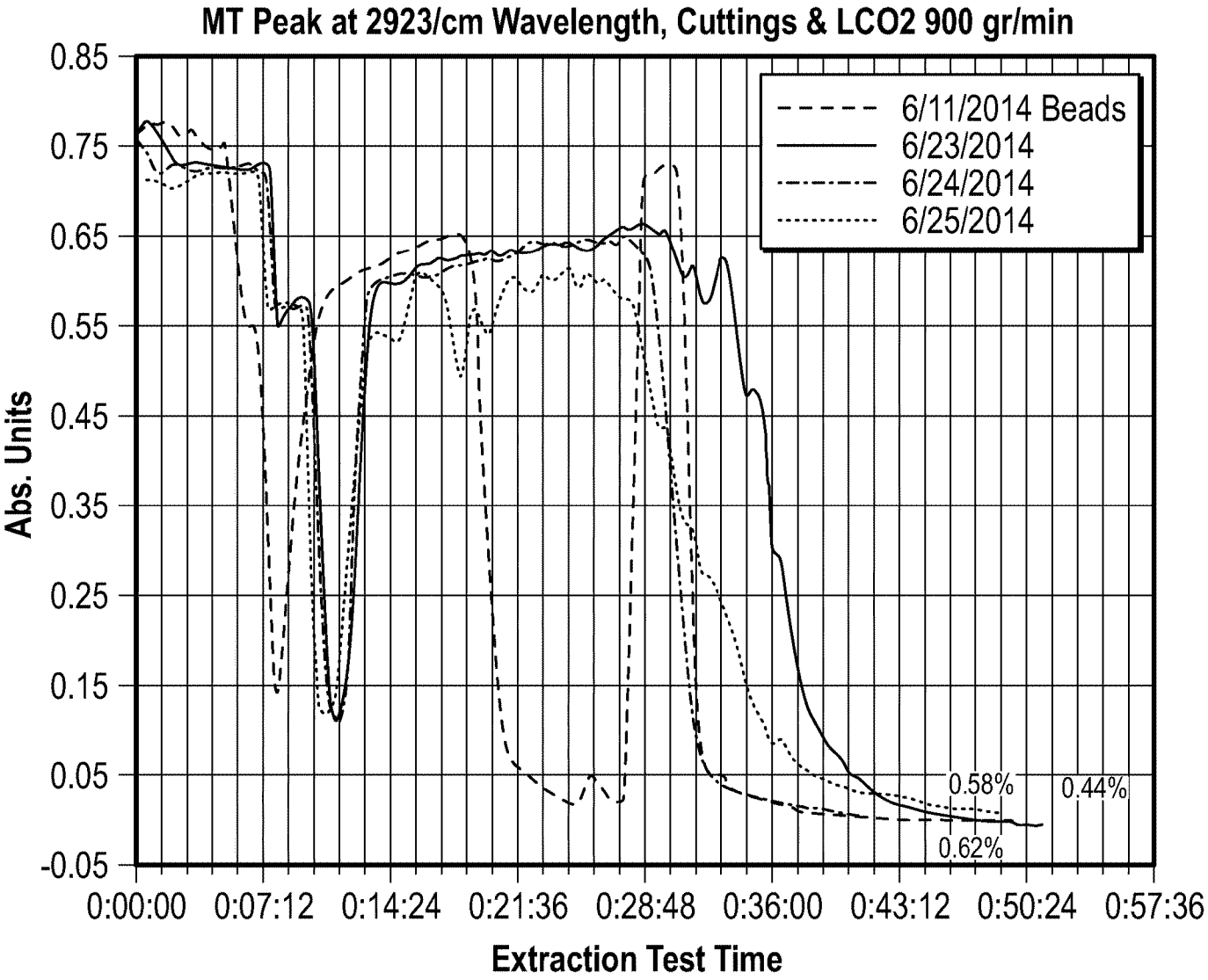
FIG. 11 illustrates a light absorption measurement plateau with $LCO_2$ flow rate of 900 grams per minute.

FIG. 11 illustrates FTIR readings vs. extraction times. 12 kilograms of drill cuttings were placed in the extraction tank where $LCO_2$ flowed into the extraction tank at 900 grams/minute. The drill cuttings hydrocarbon content was measured to be below 1% at the end of the SFE process. Beads were also used in this SFE process experiment to simulate drill cuttings. A system controller as discussed previously in this disclosure may be implemented with the SFE process to allow for an efficient and cost effective hydrocarbon extraction process for contaminated drill cuttings.

TABLE 2

Test results for the cuttings tests

| Test date | Mixture viscosity, cP | Mixture temp., Celsius | Steady state, start time | Steady state, end time | Cuttings Hydrocarbon content, % | Calc. $LCO_2$ visc., cP | Plateau duration, min | Test duration, min |
|---|---|---|---|---|---|---|---|---|
| Cuttings Test #1 | 0.115 | 18.1 | 0:25 | 0:30 | 1.07 | 0.1180 | 5 | 30 |
| Cuttings Test #2 | 0.116 | 19.6 | 0:25 | 0:25 | 3.37 | 0.1154 | 0 | 25 |
| Cuttings Test #3 | 0.105 | 18.5 | 0:27 | 0:30 | 2.54 | 0.1173 | 3 | 30 |
| Cuttings Test #4 | 0.107 | 16.5 | 0:40 | 1:00 | 0.84 | 0.1443 | 20 | 60 |
| Cuttings Test #5 | 0.120 | 19.5 | 0:49 | 0:51 | 1.07 | 0.1143 | 2 | 51 |
| Cuttings Test #6 | 0.121 | 18.3 | 0:28 | 0:40 | 1.19 | 0.1177 | 12 | 40 |
| Cuttings Test #7 | 0.128 | 20.0 | 0:44 | 0:52 | 1.25 | 0.1134 | 8 | 52 |
| Cuttings Test #8 | 0.130 | 14.5 | 0:38 | 1:10 | 0.68 | 0.1273 | 32 | 57 |
| AVG. | 0.121 | 18.0 | | | | 0.118 | | |

Figure 8:
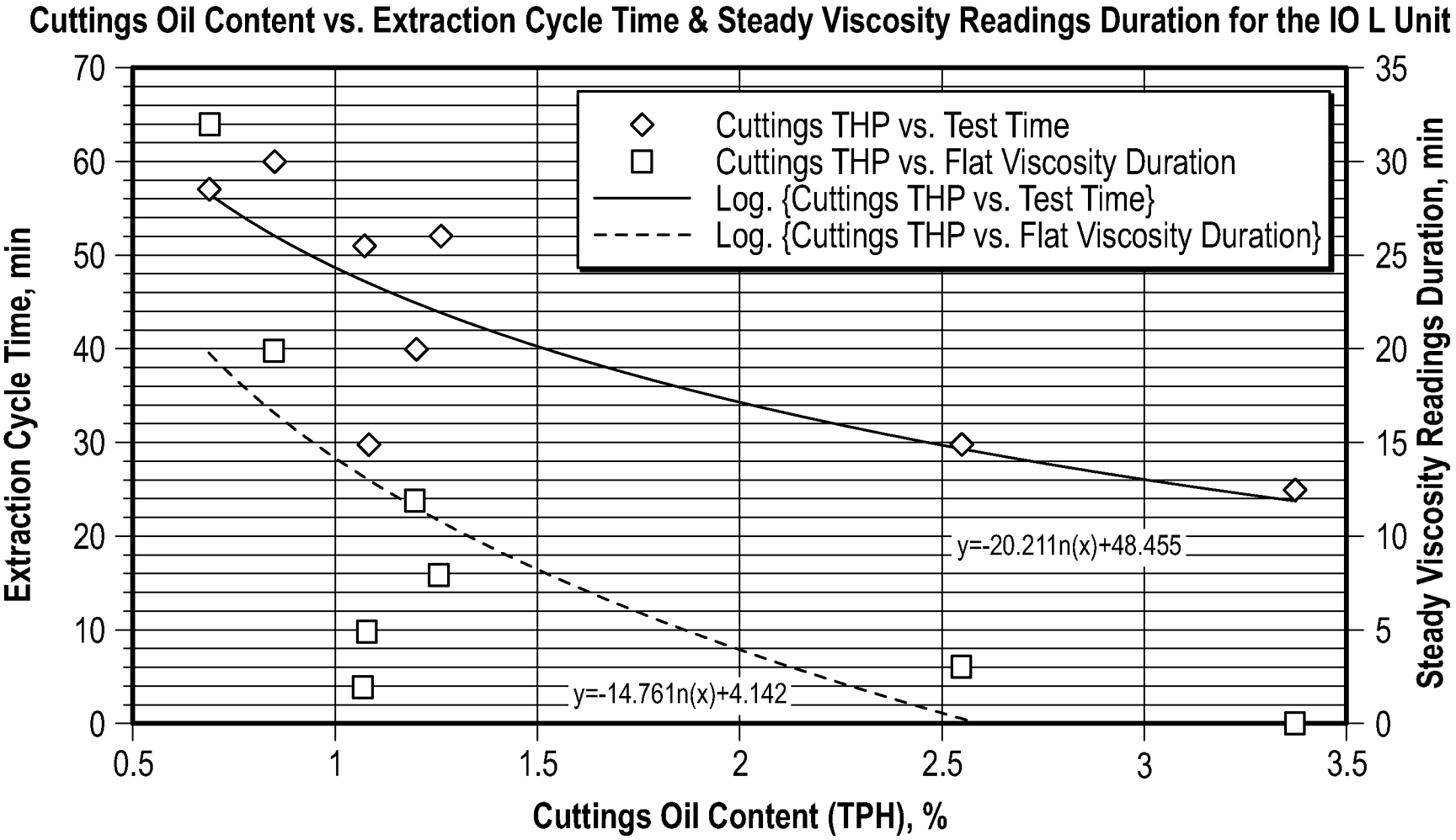
FIG. 8 shows extraction cycle times corresponding to drill cuttings hydrocarbon content.
Figure 12:
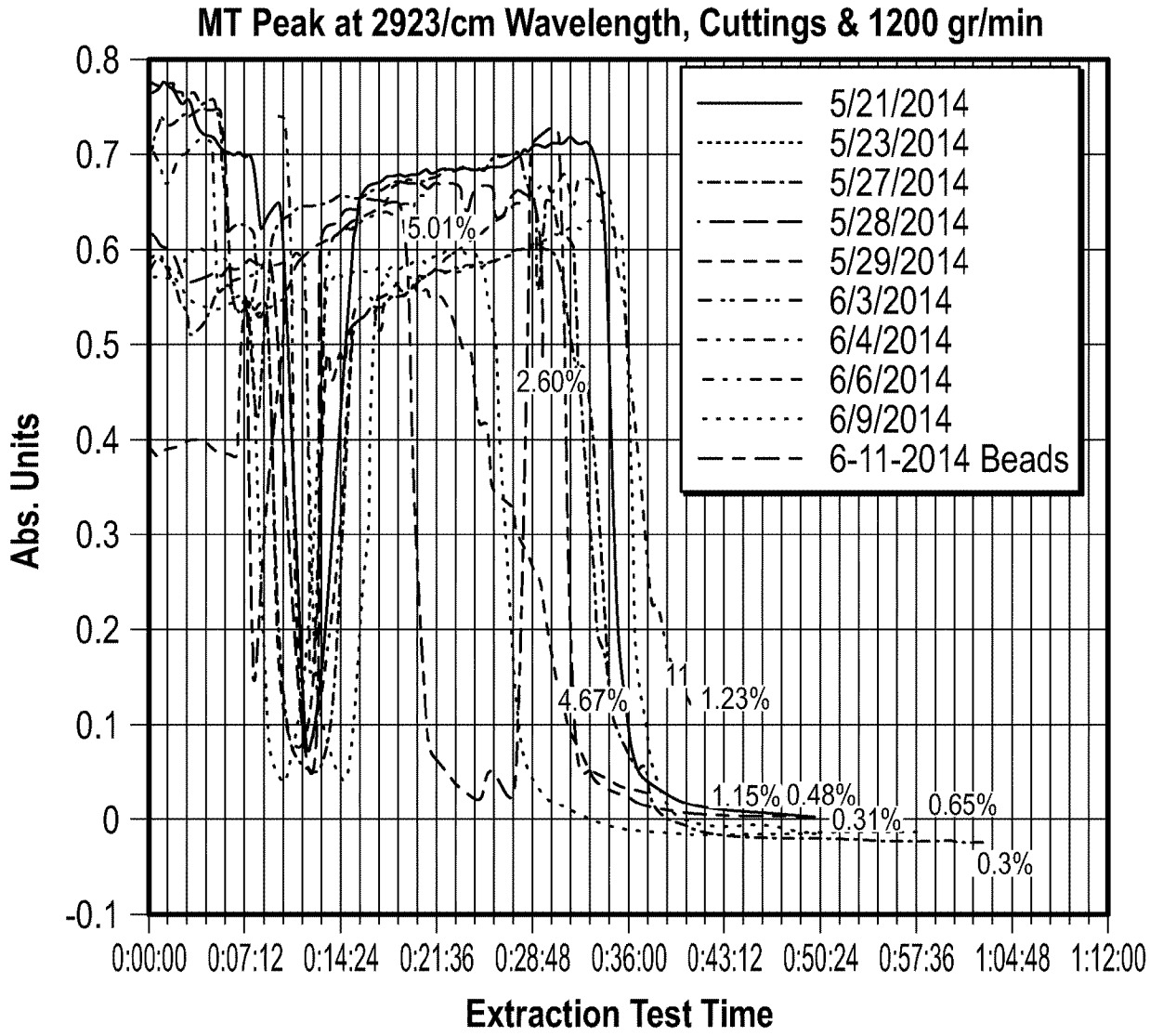
FIG. 12 illustrates a light absorption measurement plateau with $LCO_2$ flow rate of 1200 grams per minute.
Figure 13:
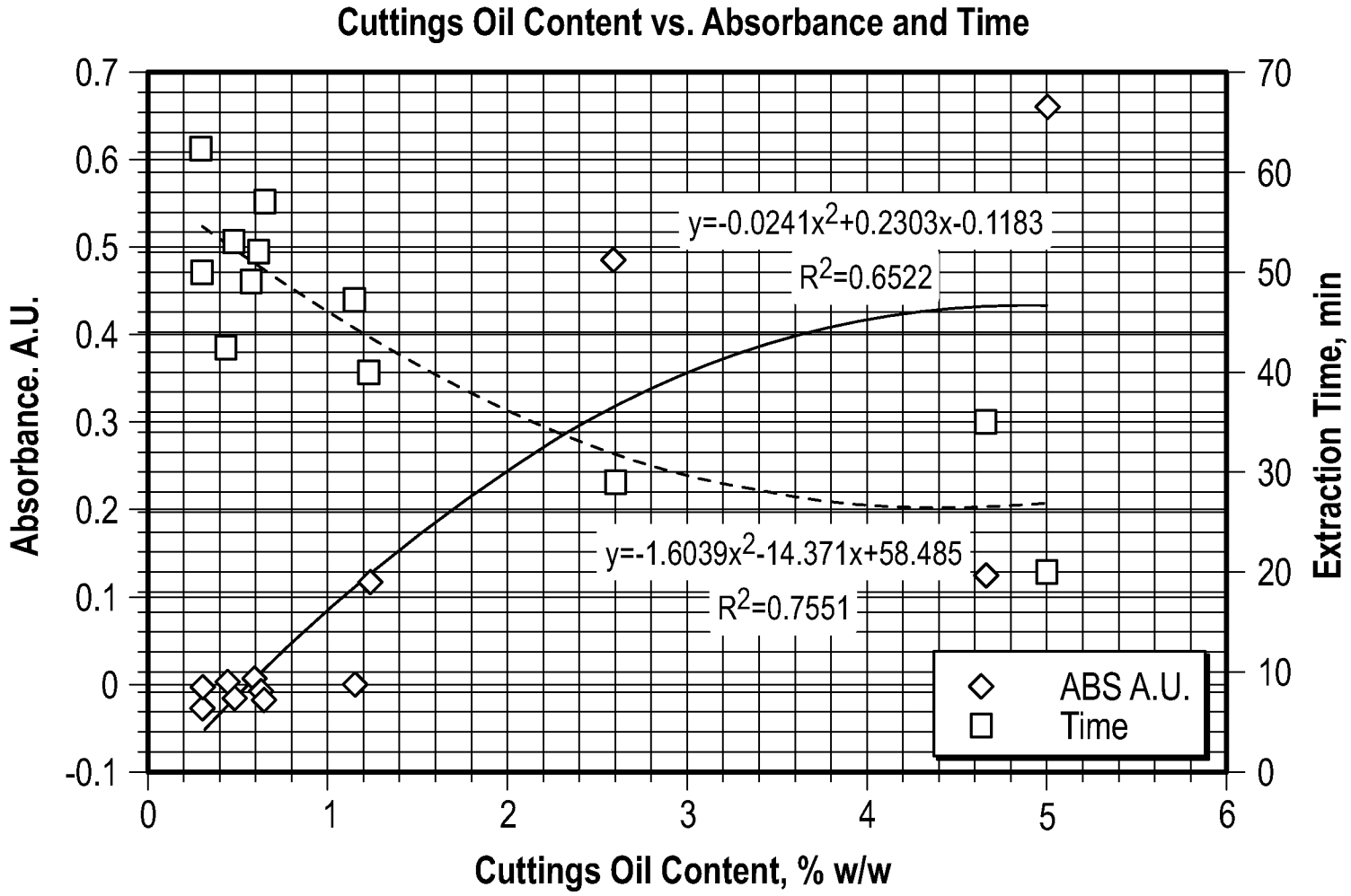
FIG. 13 graphs light absorption vs. cuttings hydrocarbon content.

The data in Table 2 is presented as Approach 2 in FIG. 8. According to FIG. 8, the average extraction and plateau times corresponding to 1 wt % drill cuttings hydrocarbon content are 49 min and 14 min, respectively. These tests indicate that a measurement device, such as a viscometer measuring a viscosity of the extraction tank effluent, which may be integrated with a system controller, may be imple- FIG. 12 illustrates FTIR readings vs. extraction times. 12 kilograms of drill cuttings were placed in the extraction tank where $LCO_2$ flowed into the extraction tank at 1200 grams/minute. As shown by the graph, light absorption values start to plateau at about 36 minutes from the beginning of the SFE process. The hydrocarbon content was about 1% or less during the plateau phase. This data is shown in Table 3.

TABLE 3

| Test # | Total Petroleum Hydrocarbon (TPH) (%) | Light Absorption (A.U.) | Time (min) | $LCO_2$ flow rate (grams/min) |
|---|---|---|---|---|
| #1 | 0.3 | −0.027 | 62 | 1200 |
| #2 | 0.65 | −0.018 | 57 | 1200 |
| #3 | 0.48 | −0.016 | 53 | 1200 |
| #4 | 0.31 | −0.002 | 50 | 1200 |
| #5 | 1.15 | 0.002 | 47 | 1200 |
| #6 | 4.67 | 0.125 | 35 | 1200 |
| #7 | 2.6 | 0.486 | 29 | 1200 |
| #8 | 1.23 | 0.118 | 40 | 1200 |
| #9 | 5.01 | 0.657 | 20 | 1200 |
| #10 | 0.44 | 0.003 | 42 | 900 |
| #11 | 0.62 | −0.006 | 52 | 900 |
| #12 | 0.58 | 0.007 | 49 | 900 |

A plot of the data in Table 3 is illustrated in FIG. 12. FIG. 5 illustrates that the hydrocarbon content is below 1% when the light absorption value is around 0. This hydrocarbon content was achieved after 46 minutes.

Table 4 shows extraction times with corresponding light absorption measurements and hydrocarbon content.

TABLE 4

| $LCO_2$ flow rate (grams/min) | Cutt. HC content, % | Absorbance, A.U. | Extraction time (minutes) |
|---|---|---|---|
| 900 | 0.41 | 0.001 | 55.3 |
| 1200 | 0.54 | −0.02 | 47.5 |

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

What is claimed is:

1. A method comprising:

passing liquid carbon dioxide over drill cuttings carrying contaminants in an extraction tank to form a mixture comprising liquid carbon dioxide and a portion of the contaminants;

transferring the mixture through a transfer line;

measuring a property of the mixture as the mixture is being transferred, via the transfer line, through at least one measurement device, wherein the measured property of the mixture is a viscosity of the mixture, the measured property of the mixture is indicative of an extent to which the contaminants have been removed from the drill cuttings, and the at least one measurement device consists of at least one viscometer;

terminating the passing liquid carbon dioxide over drill cuttings based on the measured property; and utilizing the liquid carbon dioxide as a transport medium to effectuate transfer of the drill cuttings from the extraction tank to a cleaned cuttings holding vessel based on the measured property.

2. The method of claim 1, wherein the passing liquid carbon dioxide comprises contacting the drill cuttings with liquid carbon dioxide at a temperature in a range from about 10° C. to about 30° C. and a pressure in a range from about 50 bar to about 70 bar.

3. The method of claim 1, wherein the measured property of the mixture is indicative of a contaminant content.

4. The method of claim 1, further comprising separating the mixture by adjusting a solvating power of the liquid carbon dioxide.

5. The method of claim 4, wherein the adjusting the solvating power comprises expanding the mixture to vaporize at least a portion of the liquid carbon dioxide.

6. The method of claim 5, further comprising:

recovering vaporized carbon dioxide;

liquefying the vaporized carbon dioxide;

recycling the liquefied carbon dioxide.

7. The method of claim 1, wherein the passing and the measuring are performed at least until the measured property achieves a steady state or a pseudo steady state.

8. The method of claim 1, wherein the terminating is performed at a time period of between 15 minutes and 45 minutes after the measured property achieves a steady state or a pseudo steady state.

9. The method of claim 1, further comprising fluidly connecting the extraction tank vessel to a separation tank vessel via the transfer line.

10. The method of claim 9, further comprising holding the drill cuttings carrying the contaminants in the extraction tank vessel, separating the mixture at or in the separation tank vessel, and providing a measuring device in, or fluidly connected to, the transfer line.

* * * * *